US007278861B2

(12) United States Patent
Kishi et al.

(10) Patent No.: US 7,278,861 B2
(45) Date of Patent: Oct. 9, 2007

(54) CONNECTOR ASSEMBLY

(75) Inventors: Masanori Kishi, Tsu (JP); Kenji Okura, Tsu (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 0 days.

(21) Appl. No.: 11/634,936

(22) Filed: Dec. 7, 2006

(65) Prior Publication Data

US 2007/0141867 A1 Jun. 21, 2007

(30) Foreign Application Priority Data

Dec. 15, 2005 (JP) ..... 2005-362176

(51) Int. Cl.
*H01R 12/00* (2006.01)

(52) U.S. Cl. ..... 439/74

(58) Field of Classification Search ..... 439/74, 439/570, 357, 358, 492–499
See application file for complete search history.

(56) References Cited

U.S. PATENT DOCUMENTS 5,616,050 A * 4/1997 Suski ..... 439/495
6,986,670 B2 * 1/2006 Okura et al. ..... 439/74
7,112,091 B2 * 9/2006 Okura et al. ..... 439/570

FOREIGN PATENT DOCUMENTS

| | | |
|---|---|---|
| EP | 1 739 796 | 1/2007 |
| JP | 2004-55463 | 2/2004 |
| WO | 2005/096453 | 10/2005 |

* cited by examiner

*Primary Examiner*—J. F. Duverne
(74) *Attorney, Agent, or Firm*—Armstrong, Kratz, Quintos, Hanson & Brooks LLP

(57) ABSTRACT

This connector assembly comprises a header (1) and a socket (2). The header (1) has a header contact member (4) with a first contact piece (41) and a second contact piece (42), and the socket (2) has a socket contact member (6) with a first contact piece (64) and a second contact piece (66). The first contact piece (64) of the socket contact member (6) has a first protrusion (64*a*) and the first contact piece (41) of the header contact member (4) has a second protrusion (41*a*), and the first protrusion (64*a*) and the second protrusion (41*a*) constitute a lock mechanism when the header is inserted into the socket. The second contact piece (42) of the header contact member (4) has a concave portion (42*a*) in a surface for making contact with the second contact piece (66). When the second contact pieces (42) and (66) make contact with each other, a gap is formed between the second contact piece (66) and an inner surface of the concave portion (42*a*).

3 Claims, 4 Drawing Sheets

CONNECTOR ASSEMBLY

TECHNICAL FIELD

The present invention relates to a connector assembly.

BACKGROUND ART

Japanese Non-examined Patent Publication No. 2004-55463 discloses a connector assembly comprising a header and a socket which are coupled to each other and are electrically connected to each other.

This connector assembly comprises a rectangular header 100 and a rectangular socket 200. As shown in FIG. 8, the header 100 has a header body 101 made of an insulating material, such as a synthetic resin, and a plurality of header contact members 102 made of a conductive material and held by both side walls 103 of said header body 101 along the longitudinal direction of the header body 101.

The socket 200 has a socket body 201 made of an insulating material, such as a synthetic resin, and having a connective concave portion 202 into which the header body 101 can be inserted, and a plurality of socket contact members 203 made of a conductive material and held by both side walls 204 of the socket body 201 along the longitudinal direction of the socket body 201 so that they each can come in contact with the header contact members 102 inside the connective concave portion 202 when the header body 101 is inserted into the connective concave portion 202.

Each header contact member 102 has a first contact piece 102*a* disposed on an outer side surface of the side wall 103 of the header body 101, a second contact piece 102*b* extended from the first contact piece 102*a* along the side wall 103 and disposed on an inner side surface of the side wall 103 of the header body 101, and a mounting terminal piece 102*c* extended from the second contact piece 102*b* and penetrating a bottom of the header body 101 and projecting from the header body 101 to the outside. The first contact piece 102*a* has a first protrusion 102*d* on an outer surface thereof.

Each socket contact member 203 has a mounting terminal piece 203*a* projecting from the socket body 201 to the outside, a first connecting piece 203*b* extended from one end of the mounting terminal piece 203*a* and held by an outer side surface of the side wall 204 of the socket body 201, a second connecting piece 203*c* extended from one end of the first connecting piece 203*b* toward the inside of the socket body 201, a first contact piece 203*d* extended from one end of the second connecting piece 203*c* and disposed on an inner side surface of the side wall 204, a third connecting piece 203*e* extended from one end of the first contact piece 203*d* and running toward the inside of the socket body 201 along a bottom of the connective concave portion 202, and a second contact piece 203*f* extended from one end of the third connecting piece 203*e* toward the first contact piece 203*d* and whose end is curved toward the inside of the socket body 201.

The first contact piece 203*d* has, at one end on an opening side of the connective concave portion 202, a first protrusion 203*g* elastically protruding in a direction perpendicular to the insertion direction of the header 100. The third connecting piece 203*e* is inclined toward a direction apart from the bottom of the connective concave portion 202 as it goes toward the inside of the connective concave portion 202, whereby the second contact piece 203*f* can elastically deform along the insertion direction of the header 100.

As shown in FIG. 9, when the header 100 is inserted into the socket 200, the first contact piece 102*a* of the header contact member 102 and the first contact piece 203*d* of the socket contact member 203 come in contact with each other, and the second contact piece 102*b* of the header contact member 102 and the second contact piece 203*f* of the socket contact member 203 come in contact with each other. And, the first protrusion 102*d* of the header contact member 102 and the first protrusion 203*g* of the socket contact member 203 are engaged with each other, whereby the header 100 is locked to the socket 200.

As mentioned above, because this connector assembly has two contact points between the header contact member 102 and the socket contact member 203, this connector assembly has high contact reliability, as compared with a case where the connector assembly has only one contact point. However, if foreign substances are lodged in both between the first contact pieces 102*a* and 203*d* and between the second contact pieces 102*d* and 203*f*, poor contact may occur.

DISCLOSURE OF THE INVENTION

In view of the above problem, the object of the present invention is to provide a connector assembly capable of increasing contact reliability while maintaining the height of the connector assembly in the insertion direction of the header.

A connector assembly of the present invention comprises a header and a socket. The header has a header body made of an insulating material and a header contact member made of a conductive material and held by the header body. The socket has a socket body made of an insulating material and having a connective concave portion into which the header body can be inserted and a socket contact member made of a conductive material and held by the socket body so that it can come in contact with the header contact member inside the connective concave portion when the header body is inserted into the connective concave portion.

The feature of the present invention resides in that the socket contact member has a first contact piece and a second contact piece which are provided in a spaced relation to each other in a direction perpendicular to an insertion direction of the header so that they each can make contact with the header contact member, and the header contact member has a first contact piece configured to make contact with the first contact piece of the socket contact member and a second contact piece configured to make contact with the second contact piece of the socket contact member, and one first contact piece of the socket contact member and the header contact member has a first protrusion elastically projecting in a direction perpendicular to the insertion direction of the header and the other first contact piece of the socket contact member and the header contact member has a second protrusion configured to climb over the first protrusion when the header body is inserted into the connective concave portion, and the first protrusion and the second protrusion constitutes a lock mechanism by engaging with each other when the header body is inserted into the connective concave portion, and one second contact piece of the socket contact member and the header contact member has a concave portion in a surface for making contact with the other second contact piece, and a gap is formed between the other second contact piece and an inner surface of the concave portion of the one second contact piece when the one second contact piece makes contact with the other second contact piece.

In the connector assembly of the present invention, because the concave portion is formed in one second contact piece of the header contact member and the socket contact member and the gap is formed between the other second contact piece and the inner surface of the concave portion when the second contact pieces make contact with each other, even when a foreign substance is attached to either second contact piece before the header is connected to the socket, the foreign substance is dropped in the concave portion when one second contact piece makes contact with the other second contact piece, so the foreign substance is not lodged in between the second contact pieces. So, because at least one contact point is ensured between the header contact member and the socket contact member, the contact reliability is increased.

Furthermore, because the lock mechanism is constituted by the first contact pieces and the concave portion is formed in either second contact piece and each first contact piece and each second contact piece are provided in a spaced relation to each other in the direction perpendicular to the insertion direction of the header, the height of the connector assembly in the insertion direction of the header is not increased, even when the concave portion is formed.

Preferably, said the other second contact piece has a connective protrusion which partly gets in the concave portion of said one second contact piece and makes contact with edges on opposite sides of an opening of the concave portion in the direction perpendicular to the insertion direction of the header, and an angle which tangent planes of the connective protrusion at contact locations between the connective protrusion and the edges of the concave portion form with each other is larger than an angle which tangent planes of the inner surfaces of the concave portion at the contact locations form with each other.

In this case, the connective protrusion and the concave portion make line contact or point contact with each other. So, as compared with a case where the connective protrusion and the concave portion make surface contact, the contact pressure between the connective protrusion and the concave portion is increased, so the contact reliability can be more increased.

Preferably, the header contact member or the socket contact member that has the connective protrusion is formed from a metal plate, and the connective protrusion is formed at one end of the metal plate.

In general, an end of the metal plate is easy to grind or bend. So, in this case, it is easy to form the connective protrusion.

BEST MODE FOR CARRYING OUT THE INVENTION

Hereinafter, the present invention will be described in more detail with reference to the accompanying drawings.

Figure 1:
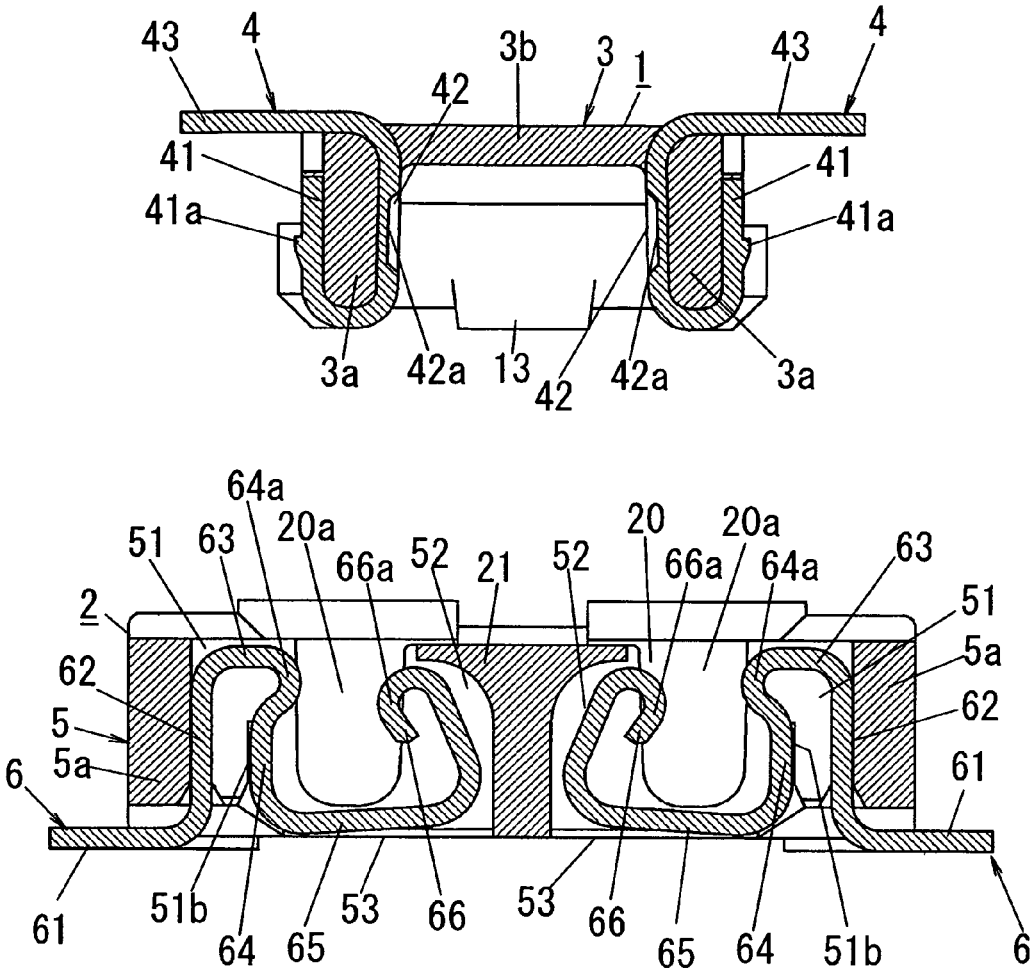
FIG. 1 is a cross-section view, along a line A—A of FIG. 5, of a connector assembly in accordance with an embodiment of the present invention in a condition where a header is separated from a socket.

As shown in FIG. 1, a connector assembly of this embodiment comprises a header 1 and the socket 2 which the header 1 can be inserted into or pulled out of.

Figure 3:
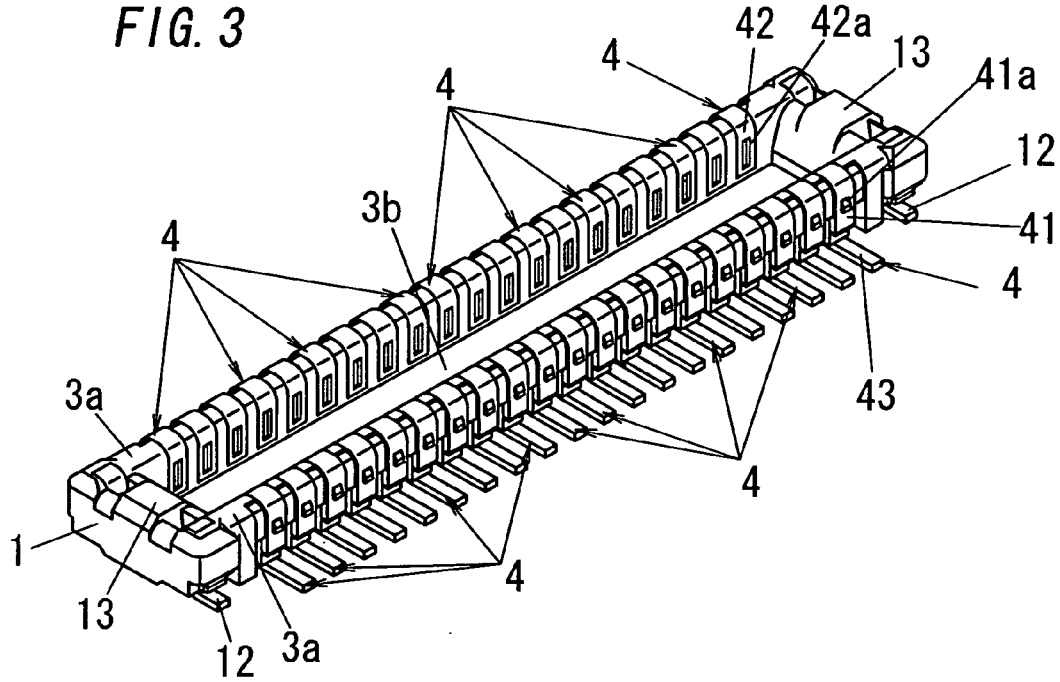
FIG. 3 is a perspective view of the header of the connector assembly of FIG. 1.

As shown in FIG. 3, the header 1 has a header body 3 having an elongated rectangular shape and made of an insulating material, such as a synthetic resin, and a plurality of header contact members 4 each of which was made of a conductive material and held by the header body 3. The header body 3 has a bottom 3*b* and side walls 3*a* formed around the bottom 3*b*, and the header contact members 4 are held by opposite side walls 3*a* along the longitudinal direction of the header body 101 by insert molding. In this embodiment, twenty header contact members 4 are provided on each side wall 3*a*. And, mounting terminals 12 for fixing the header 1 on an external component by soldering is provided at both ends in the longitudinal direction of the header body 3. A protrusion 13 is formed at an end of each side wall at both ends in the longitudinal direction of the header body 3.

Figure 4:
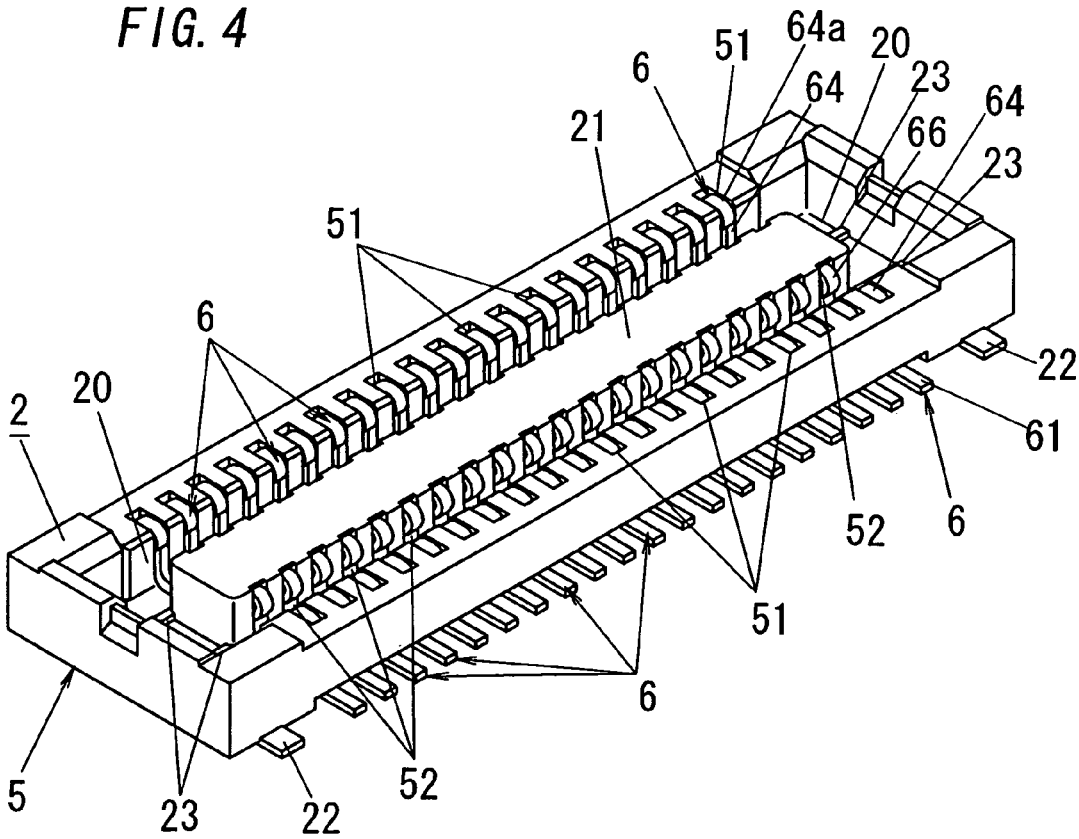
FIG. 4 is a perspective view showing the socket of the connector assembly of FIG. 1.
Figure 5:
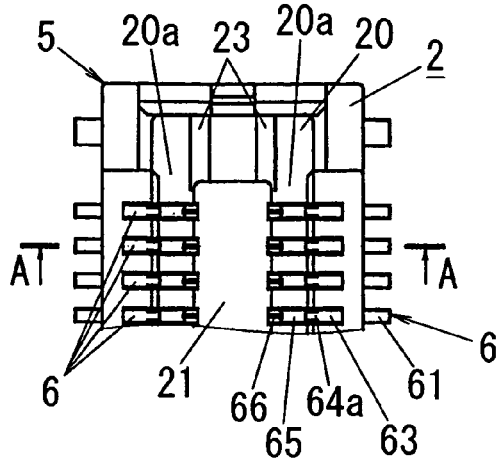
FIG. 5 is a plan view showing a substantial part of the socket of the connector assembly of FIG. 1.

As shown in FIGS. 4 and 5, the socket 2 has a socket body 5 made of an insulating material, such as a synthetic resin, and having a connective concave portion 20 into which the header body 3 can be inserted, and a plurality of socket contact members 6 each of which was made of a material having conductivity and elasticity and held by the socket body 5 so that it can come in contact with each header contact member 4 inside the connective concave portion 20 when the header body 3 is inserted into the connective concave portion 20. The connective concave portion 20 has a convex portion 21 along the longitudinal direction of the socket body, and the convex portion 21 and side walls 5*a* of the socket body 5 along the longitudinal direction thereof form two grooves 20*a* along the longitudinal direction of the socket body 5. In this embodiment, twenty socket contact members 6 are arranged in each groove 20*a* of the socket body 5. And, mounting terminals 22 for fixing the socket body 5 on an external component by soldering are provided at both ends of the socket body 5 in the longitudinal direction thereof.

Figure 2:
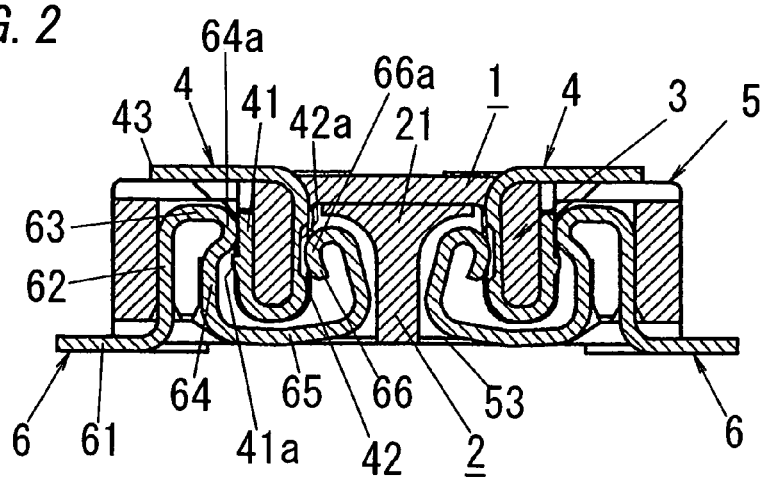
FIG. 2 is a cross-section view showing the connector assembly of FIG. 1 in a condition where the header is connected to the socket.

As shown in FIG. 2, the header 1 is inserted into the socket 2 so that each side wall 3*a* along the longitudinal direction of the header 1 is inserted in each groove 20*a*, and each socket contact member 6 arranged in each groove 20*a* and each header contact member 4 provided in each side wall 3*a* of the header body 3 make contact with each other.

For reference, as shown in FIGS. 4 and 5, two steps 23 are formed in a spaced relation to each other at each ends of the connective concave portion 20 of the socket body 5 in the longitudinal direction thereof, and when the header 1 is inserted into the socket 2, each protrusion 13 of the header 1 is inserted into between the two steps 23. By this, even when an external force acts on the header 1 in the direction perpendicular to the longitudinal direction of the header 1 in a condition where the header 1 is connected to the socket 2, the external force acts the steps 23 and the protrusion 13, whereby mechanical strength between the header 1 and the socket 2 is increased. Furthermore, by forming the steps 23, a wall thickness of the bottom of the connective concave portion 20 is increased, whereby mechanical strength of the socket 2 itself is increased and it becomes easy to mold the socket body 5.

Next, each contact member will be explained below.

Each socket contact member 6 is formed by bending an elongated metal plate. As shown in FIG. 1, each socket contact member 6 has a mounting terminal piece 61 protruding from the socket body 5 to the outside, a first connecting piece 62 extended from one end of the mounting terminal piece 61 and held by the side wall 5*a* of the socket body 5, a second connecting piece 63 extended from one end (an upper end in FIG. 1) of the first connecting piece 62 and running toward the inside of the socket body 5, a first contact piece 64 extended from one end of the second connecting piece 63 on the convex portion 21 side and running toward the bottom side of the connective concave portion 20, a third connecting piece 65 extended from one end of the first contact piece 64 on the bottom side and running toward the convex portion 21 along the bottom of the connective concave portion 20, and a second contact piece 66 which is extended from one end of the third connecting piece 65 on the convex portion 21 side and runs toward an opening of the connective concave portion 20 (upward direction in FIG. 1) and whose tip is bent toward the bottom side of the connective concave portion 20.

The first contact piece 64 and the second contact piece 66 are separated from each other in a direction perpendicular to the insertion direction of the header 1 so that they each can make contact with the header contact member 4.

Figure 6A:
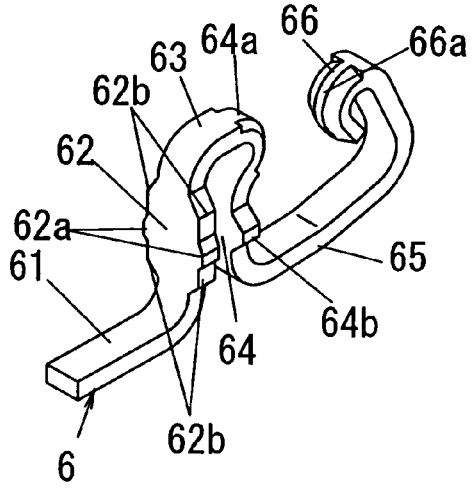
FIGS. 6A and 6B are perspective views showing a socket contact member of the connector assembly of FIG. 1.
Figure 6B:
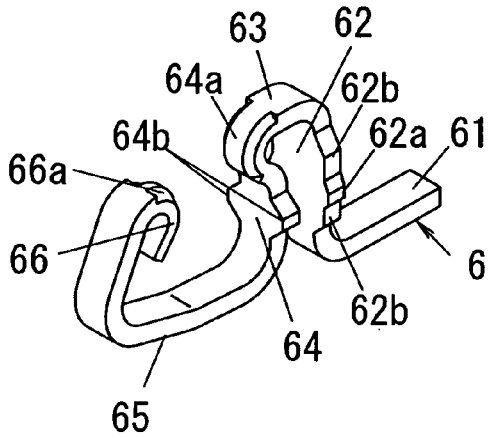

As shown in FIGS. 6A and 6B, at an end on the header side of the first contact piece 64 (that is, an upper end of the first contact piece 64 in FIG. 1), a first protrusion 64*a* having a curved surface shape and protruding toward the second contact piece 66 is formed.

Furthermore, on a curved outer surface of the tip of the second contact piece 66, a connective protrusion 66*a* is formed by polishing and so on so that a center of the metal plate in the width direction becomes higher than both sides of the metal plate.

Each socket contact member 6 constituted as above is housed in the socket body 5.

As shown in FIGS. 1 and 4, each side wall 5*a* along the longitudinal direction of the socket body 5 has twenty grooves 51, and the convex portion 21 of the socket body 5 also has twenty grooves 52 each of which faces the groove 51. Furthermore, in the bottom of the connective concave portion 20, through holes 53 each of which is communicated with each groove 51 and each groove 52 are formed.

As shown in FIG. 1, each socket contact member 6 is attached to the socket body 5 from the outer bottom side of the socket body 5 through the through hole 53 so that the first connecting piece 62, the second connecting piece 63 and the first contact piece 64 are disposed in the groove 51 and the second contact piece 66 is disposed in the groove 52. The first protrusion 64*a* and the connective protrusion 66*a* each elastically project toward the inside of the groove 20*a*. In other words, the first protrusion 64*a* and the connective protrusion 66*a* each elastically project in the direction perpendicular to the insertion direction of the header 1. The third connecting piece 65 is inclined to a direction apart from the bottom of the connective concave portion 20 as it nears the convex portion 21, whereby the third connecting piece 65 and the second contact piece 66 can elastically deform in the insertion direction of the header 1.

For reference, as shown in FIGS. 6A and 6B, the first connecting piece 62 of each socket contact member 6 has first steps 62*b* projecting outward on both sides in the width direction of the first connecting piece 62 and second steps 62*a* projecting outward from the center of each first step 62*b*. Furthermore, the first contact piece 64 has third steps 64*b* projecting outward on both sides thereof in the width direction. Each inner surface of the groove 51 of the socket body 5 has, at a position facing the first step 62*b* of the first connecting piece 62, a holding concave portion (not shown) whose bottom is opened, and the first connecting piece 62 is inserted into the groove 51 as the first step 62*b* is inserted into the holding concave portion, and the first connecting piece 62 is secured to the socket body 5 by pressing the second step 62*a* into the inner surface of the holding concave portion. Furthermore, each groove 51 of the socket body 5 has, at a position facing the third step 64*b* of the first contact piece 64, a guiding concave portion 51*b* (see FIG. 1) whose bottom is opened, and the third step 64*b* of the first contact piece 64 is disposed in the guiding concave portion 51*b* when the socket contact member 6 is attached to the socket body 5, whereby the socket contact member 6 can maintain a posture. The guiding concave portion 51*b* has a clearance between the inner surface thereof and the third step 64*b* in the direction perpendicular to the insertion direction of the header 1, and by this clearance, the first protrusion 64*a* of the first contact piece 64 can elastically deform in the direction perpendicular to the insertion direction of the header 1. By this elastic deformation of the first protrusion 64*a* of the first contact piece 64, a force necessary for inserting or pulling the header 1 into or out of is reduced, and it becomes easy to insert or pull the header 1 into or out of the socket 2.

Next, each header contact member 4 will be explained below. Each header contact member 4 is also formed by bending an elongated metal plate. As shown in FIG. 1, each header contact member 4 has a first contact piece 41 disposed on an outer side surface of the side wall 3*a* of the header body 3 so that it can make contact with the first contact piece 64 of the socket contact member 6, a second contact piece 42 extended from the first contact piece 41 and running along the side wall 3*a* and disposed on an inner side surface of the side wall 3*a* so that it can make contact with the second contact piece 66 of the socket contact member 6, and a mounting terminal piece 43 extended from the second contact piece 42 and penetrating the bottom 3*b* of the header body 3 and projecting from the header body 3 to the outside.

The first contact piece 41 of each header contact member 4 has, on its outer surface, a second protrusion 41*a* configured to climb over the first protrusion 64*a* of the socket contact member 6 when the header body 3 is inserted into the connective concave portion 20. The second protrusion 41*a* has, on a socket 2 side, an inclined surface which slopes gently toward the socket 2.

Figure 7:
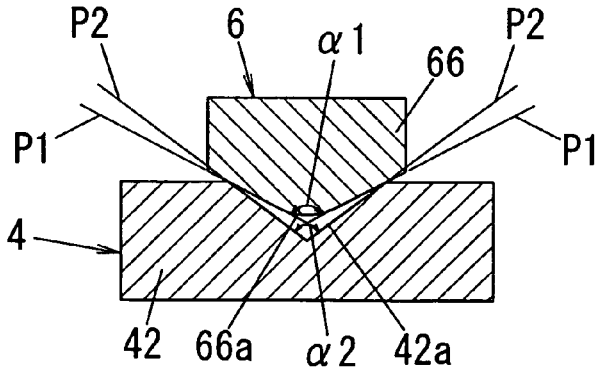
FIG. 7 is a view for explaining a contact state between a connective protrusion and a concave portion in the connector assembly of FIG. 1.
Figure 8:
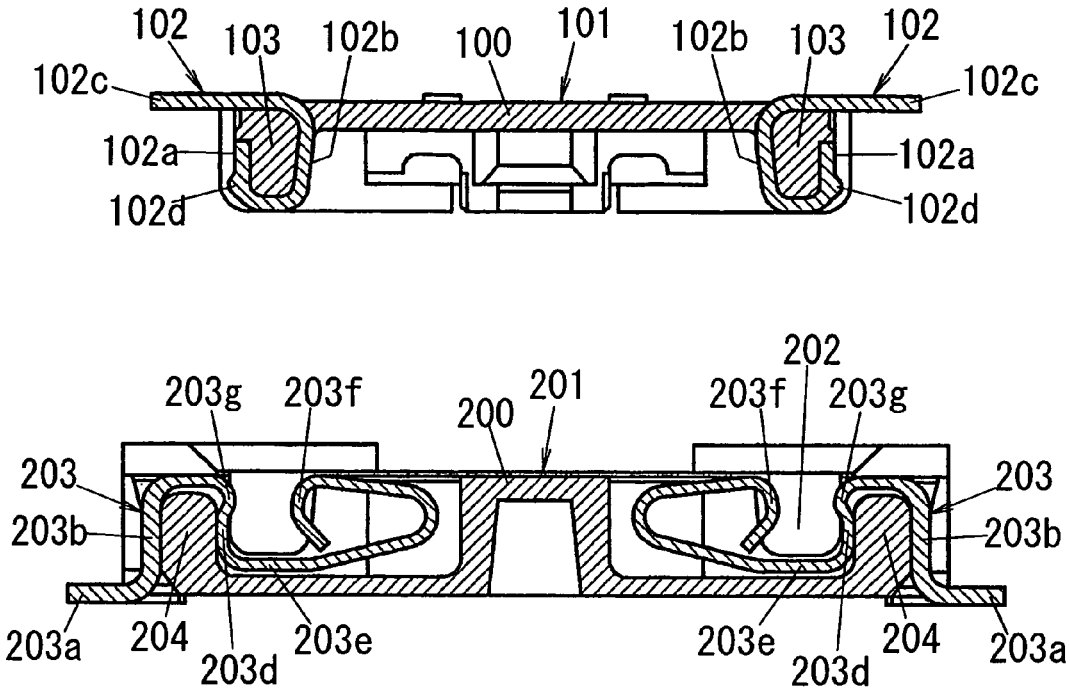
FIG. 8 is a cross-section view of a conventional connector assembly in a condition where a header is separated from a socket.
Figure 9:
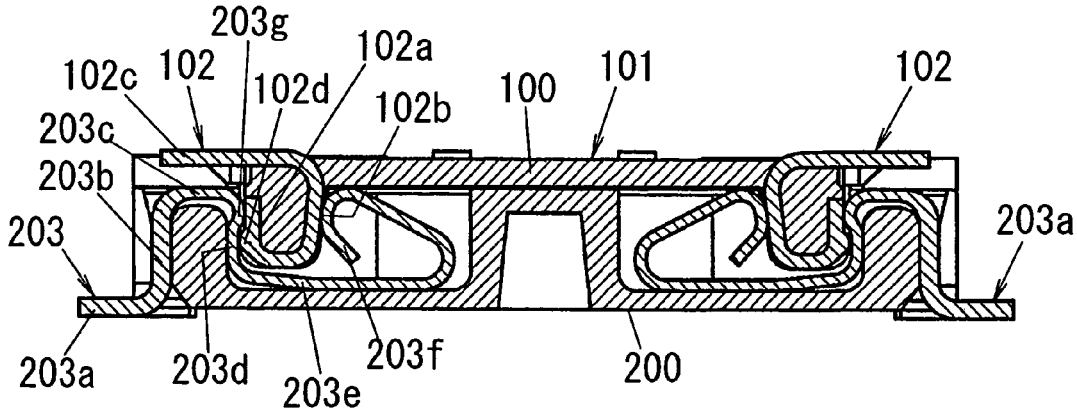
FIG. 9 is a cross-section view showing the connector assembly of FIG. 8 in a condition where the header is connected to the socket.

Furthermore, the second contact piece 42 of each header contact member 4 has a concave portion 42*a* (see FIG. 3) which is elongated along the longitudinal direction of the second contact piece 42 in a surface for making contact with the second contact piece 66 of the socket contact member 6. As shown in FIG. 7, the concave portion 42*a* has a V-shaped cross-section in a direction perpendicular to the longitudinal direction of the second contact piece 42.

When the header 3 is inserted into the connective concave portion 20, the second protrusion 41*a* of each header contact member 4 climbs over the first protrusion 64*a* of each socket contact member 6, and, as shown in FIG. 2, the first protrusion 64*a* of each socket contact member 6 makes contact with the first contact piece 41 of each header contact member 4 and the connective protrusion 66*a* of each socket contact member 6 makes contact with the second contact piece 42 of each header contact member 4.

At that time, the second protrusion 41*a* of each header contact member 4 is disposed under the first protrusion 64*a* of each socket contact member 6 (that is, on the bottom side in FIG. 1) and the first protrusion 64*a* and the second protrusion 41*b* constitute a lock mechanism for preventing a drop of the header 1 by engaging with each other. When the second protrusion 41*a* climbs over the first protrusion 64*a*, a worker can get a tactile response. In addition, because the second protrusion 41*a* has the inclined surface on the socket 2 side, a force necessary for inserting the header 1 is reduced, so that it is easy to insert the header 1 into the socket 2.

Furthermore, as shown in FIG. 7, the tip of the connective protrusion 66*a* of each socket contact member 6 gets in the concave portion 42*a* of the second contact piece 42 of each header contact member 4, and both sides of the tip of the connective protrusion 66*a* make contact with edges on opposite sides of an opening of the concave portion 42*a* in the direction perpendicular to the insertion direction of the header 1, and a gap is formed between the connective protrusion 66*a* and the inner surface of the concave portion 42*a*. In other words, a gap is formed between the second contact piece 66 of each socket contact member 6 and the inner surface of the concave portion 42*a* of the second contact piece 42 of each header contact member 4 when the second contact piece 42 of each header contact member 4 makes contact with the second contact piece 66 of each socket contact member 6.

By the above constitution, even when a foreign substance is attached to either second contact piece before the header 1 is connected to the socket 2, the foreign substance is dropped in the concave portion 42*a* when one second contact piece 42 makes contact with the other second contact piece 66, so that the foreign substance is not lodged in between the second contact pieces 42 and 66. So, because at least one contact point of the second contact pieces 42 and 66 is ensured between the header contact member 4 and the socket contact member 6, the contact reliability is increased.

If the lock mechanism and the concave portion 42*a* are arranged along the insertion direction of the header 1, the height of the connector assembly in the insertion direction of the header 1 may be increased. In this embodiment, because the lock mechanism is constituted by the first contact pieces 41 and 64 and the concave portion 42*a* is formed in the second contact piece 42 which is apart from the first contact piece 41 in the direction perpendicular to the insertion direction of the header 1, the height of the connector assembly in the insertion direction of the header 1 is not increased even when the concave portion is provided.

That is, the connector assembly of this embodiment can increase contact reliability while maintaining the height of the connector assembly in the insertion direction of the header.

In addition, as shown in FIG. 7, in this embodiment, an angle a1 which tangent planes P1 and P1 of the connective protrusion 66*a* at contact locations between the connective protrusion 66*a* and the edges of the opening of the concave portion 42*a* form with each other is larger than an angle a2 which tangent planes P2 and P2 of the inner surfaces of the concave portion 42*a* at the contact locations form with each other (that is, a1>a2 in FIG. 7). In this case, the connective protrusion 66*a* and the concave portion 42*a* make line contact or point contact with each other. So, as compared with a case where the connective protrusion 66*a* and the concave portion 42*a* make surface contact, the contact pressure between the connective protrusion 66*a* and the concave portion 42*a* is increased, so the contact reliability can be more increased.

Furthermore, in this embodiment, the connective protrusion 66*a* is formed at an end of the metal plate of the socket contact member 6. In general, an end of the metal plate is easy to grind or bend. So, when the connective protrusion 66*a* is formed at an end of the metal plate, it is easy to form the connective protrusion 66*a*.

Although, in this embodiment, the concave portion 42*a* is formed in the header contact member 4 and the connective protrusion 66*a* is formed on the socket contact member 6, the concave portion 42*a* may be formed in the socket contact member 6 and the connective protrusion 66*a* may be formed on the header contact member 4.

As mentioned above, as many apparently widely different embodiments of this invention may be made without departing from the spirit and scope thereof, it is to be understood that the invention is not limited to the specific embodiments thereof except as defined in the appended claims.

The invention claimed is:

1. A connector assembly comprising:

a header: said header having a header body made of an insulating material and a header contact member made of a conductive material and held by said header body;

a socket: said socket having a socket body made of an insulating material and having a connective concave portion into which said header body is inserted and a socket contact member made of a conductive material and held by said socket body so that it is in contact with said header contact member inside said connective concave portion when said header body is inserted into said connective concave portion;

wherein said socket contact member has a first contact piece and a second contact piece which are provided in a spaced relation to each other in a direction perpendicular to an insertion direction of said header so that they each can make contact with said header contact member, said header contact member having a first contact piece configured to make contact with said first contact piece of said socket contact member and a second contact piece configured to make contact with said second contact piece of said socket contact member, one first contact piece of said socket contact member and said header contact member having a first protrusion elastically projecting in a direction perpendicular to the insertion direction of said header and the other first contact piece of said socket contact member and said header contact member having a second protrusion configured to climb over said first protrusion when said header body is inserted into said connective concave portion, said first protrusion and said second protrusion constituting a lock mechanism by engaging with each other when said header body is inserted into said connective concave portion, one second contact piece of said socket contact member and said header contact member having a concave portion in a surface which is for making contact with the other second contact piece, a gap being formed between said the other second contact piece and an inner surface of said concave portion of said one second contact piece when said one second contact piece makes contact with said the other second contact piece.

2. The connector assembly as set forth in claim 1, wherein said the other second contact piece has a connective protrusion which partly gets in said concave portion of said one second contact piece and makes contact with edges on opposite sides of an opening of said concave portion in the direction perpendicular to the insertion direction of the header, an angle which tangent planes of said connective protrusion at contact locations between said connective protrusion and the edges of said concave portion form with each other being larger than an angle which tangent planes of the inner surfaces of said concave portion at the contact locations form with each other.

3. The connector assembly as set forth in claim 2, wherein said header contact member or said socket contact member that has said connective protrusion is formed from a metal plate, said connective protrusion being formed at one end of said metal plate.

* * * * *